US009964339B2

(12) United States Patent
Ali et al.

(10) Patent No.: US 9,964,339 B2
(45) Date of Patent: May 8, 2018

(54) COOLING SYSTEM WITH LOW TEMPERATURE LOAD

(71) Applicant: Heatcraft Refrigeration Products LLC, Stone Mountain, GA (US)

(72) Inventors: Masood Ali, Hatchechubbee, AL (US); Augusto J. Pereira Zimmermann, Lilburn, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 131 days.

(21) Appl. No.: 15/000,817

(22) Filed: Jan. 19, 2016

(65) Prior Publication Data

US 2017/0205120 A1 Jul. 20, 2017

(51) Int. Cl.

| | |
|---|---|
| ***F25B 1/00*** | (2006.01) |
| ***F25B 9/00*** | (2006.01) |
| ***F25B 31/00*** | (2006.01) |
| ***F25B 41/00*** | (2006.01) |
| ***F25B 1/10*** | (2006.01) |
| ***F25B 5/02*** | (2006.01) |
| ***F25B 40/00*** | (2006.01) |
| ***F25B 41/04*** | (2006.01) |

(52) U.S. Cl.

CPC ..... *F25B 9/008* (2013.01); *F25B 1/10* (2013.01); *F25B 5/02* (2013.01); *F25B 31/00* (2013.01); *F25B 40/00* (2013.01); *F25B 41/003* (2013.01); *F25B 41/04* (2013.01); *F25B 2341/0662* (2013.01); *F25B 2400/054* (2013.01); *F25B 2400/06* (2013.01); *F25B 2400/13* (2013.01); *F25B 2400/16* (2013.01); *F25B 2500/28* (2013.01)

(58) Field of Classification Search

CPC ..... F25B 9/008; F25B 31/00
USPC ..... 62/115, 498
See application file for complete search history.

(56) References Cited

U.S. PATENT DOCUMENTS

2009/0025405 A1 1/2009 Kemal

FOREIGN PATENT DOCUMENTS

| | | |
|---|---|---|
| EP | 1707901 A2 | 10/2006 |
| EP | 2317251 A1 | 5/2011 |
| JP | 2000337722 A | 12/2000 |
| WO | WO 2008140454 A1 | 11/2008 |
| WO | WO 2009152593 A1 | 12/2009 |

OTHER PUBLICATIONS

EP Extended European Search Report for Application No./Patent No. 17151860.8-1602, dated May 17, 2017.

*Primary Examiner* — Melvin Jones
(74) *Attorney, Agent, or Firm* — Baker Botts L.L.P.

(57) ABSTRACT

A system includes a flash tank, a load, a first compressor, a second compressor, a refrigerant routing line, and a flash gas bypass line. The flash tank stores a refrigerant. The load uses the refrigerant from the flash tank to remove heat from a space proximate the load. The first compressor compresses the refrigerant from the load. The refrigerant routing line routes the refrigerant from the first compressor to the flash tank below a liquid level line of the flash tank. The flash gas bypass line is coupled to the flash tank and sends the refrigerant as a flash gas from the flash tank to the second compressor. The second compressor compresses the refrigerant.

18 Claims, 4 Drawing Sheets

COOLING SYSTEM WITH LOW TEMPERATURE LOAD

TECHNICAL FIELD

This disclosure relates generally to a cooling system, specifically a refrigeration system with a low temperature load.

BACKGROUND

Refrigeration systems may be configured in a carbon dioxide booster system. This system may cycle $CO_2$ refrigerant to cool a space using refrigeration. The refrigerant may be cycled through a low temperature load, low temperature compressor(s), a medium temperature load, and medium temperature compressor(s).

SUMMARY OF THE DISCLOSURE

According to one embodiment, a system includes a high side heat exchanger, a flash tank, a load, a first compressor, a second compressor, a refrigerant routing line, and a flash gas bypass line. The high side heat exchanger removes heat from a refrigerant. The flash tank stores the refrigerant from the high side heat exchanger. The load uses the refrigerant from the flash tank to remove heat from a space proximate the load. The first compressor compresses the refrigerant from the load. The refrigerant routing line routes the refrigerant from the first compressor to the flash tank below a liquid level line of the flash tank. The flash gas bypass line is coupled to the flash tank and sends the refrigerant as a flash gas from the flash tank to the second compressor. The second compressor compresses the refrigerant and sends the refrigerant to the high side heat exchanger.

According to another embodiment, a method includes removing, by a high side heat exchanger, heat from a refrigerant and storing, by a flash tank, the refrigerant from the high side heat exchanger. The method also includes using, by a load, the refrigerant from the flash tank to remove heat from a space proximate the load and compressing, by a first compressor, the refrigerant from the load. The method further includes routing, by a refrigerant routing line, the refrigerant from the first compressor to the flash tank below a liquid level line of the flash tank and sending, by a flash gas bypass line coupled to the flash tank, the refrigerant as a flash gas from the flash tank to a second compressor. The method also includes compressing, by the second compressor, the refrigerant and sending, by the second compressor, the refrigerant to the high side heat exchanger.

According to yet another embodiment, a system includes a flash tank, a load, a first compressor, a second compressor, a refrigerant routing line, and a flash gas bypass line. The flash tank stores a refrigerant. The load uses the refrigerant from the flash tank to remove heat from a space proximate the load. The first compressor compresses the refrigerant from the load. The refrigerant routing line routes the refrigerant from the first compressor to the flash tank below a liquid level line of the flash tank. The flash gas bypass line is coupled to the flash tank and sends the refrigerant as a flash gas from the flash tank to the second compressor. The second compressor compresses the refrigerant.

Certain embodiments may provide one or more technical advantages. For example, an embodiment allows for the safe operation of a medium temperature compressor when a medium temperature load is not present in a $CO_2$ booster system by routing refrigerant from a low temperature compressor to a flash tank below a liquid level line of the flash tank and then sending flash gas from the flash tank to the medium temperature compressor. As another example, an embodiment reduces the temperature and/or pressure of a superheated refrigerant by routing the superheated refrigerant to a flash tank below the liquid level line of the flash tank. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Cooling systems, such as for example refrigeration systems, may be configured in a $CO_2$ booster configuration. These systems may cycle refrigerant from a flash tank through low temperature loads and medium temperature loads to cool spaces corresponding to those loads. For example, in a grocery store, the low temperature loads may be freezers used to store frozen foods and the medium temperature loads may be refrigerated shelves used to store fresh produce. The refrigerant from the low temperature load is sent through low temperature compressors, and then that compressed refrigerant is mixed with refrigerant from the medium temperature load and refrigerant from the flash tank. That mixture is then sent through medium temperature compressors and then cycled back to the condenser.

By mixing the refrigerant from the low temperature compressor with refrigerant from the medium temperature load and from the flash tank, the temperature of the refrigerant from the low temperature compressor may be reduced before being sent to the medium temperature compressor. However, when the medium temperature load is not present and/or removed from the refrigeration system, the refrigerant from the medium temperature load is not included in the mixture. As a result, the temperature of the mixture may be too high for the medium temperature compressors to handle safely. Unsafe operating conditions may result if that mixture is sent to the medium temperature compressors (e.g., overheating the medium temperature compressors and/or causing the medium temperature compressors to fail or compressor protection mechanisms to trip with loss of refrigeration to the system owner).

This problem also occurs when the medium temperature load and the low temperature load are imbalanced. For example, the low temperature load could be operating much more actively than the medium temperature load. As a result, the medium temperature load may not send enough refrigerant to mix with the refrigerant from the low temperature compressor. The temperature of the refrigerant received by the medium temperature compressor would then be too high for the medium temperature compressor to safely compress.

This disclosure contemplates a configuration of the refrigeration system that lowers the temperature of the unsafe mixture and avoids such unsafe operating conditions. In the configuration, the refrigerant from the low temperature compressor is routed through the flash tank before being received by the medium temperature compressor. In this manner, the refrigerant may be cooled by the liquid refrigerant in the flash tank before being sent to the medium temperature compressor.

Figure 1:
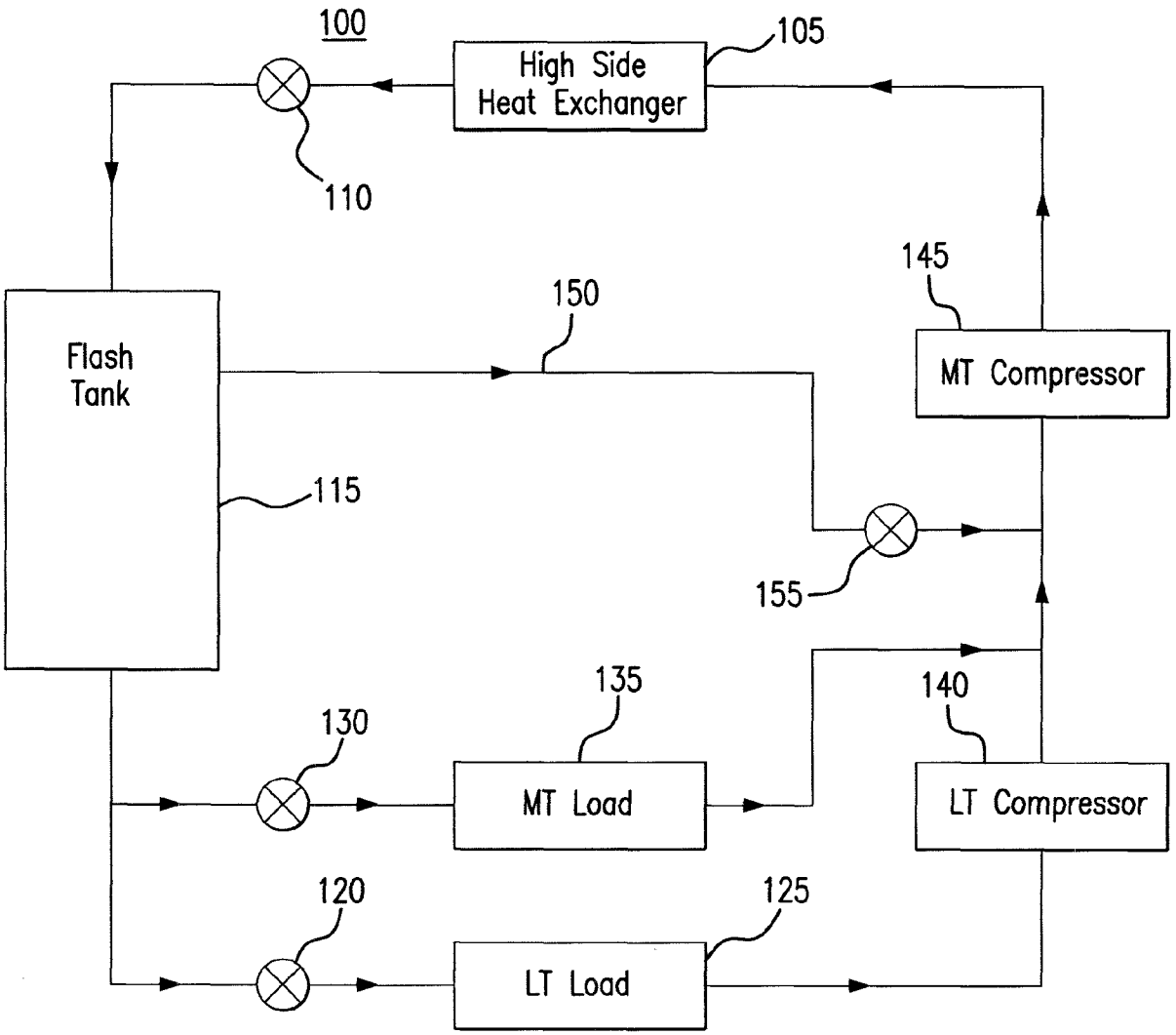
FIG. 1 illustrates an example cooling system.
Figure 2:
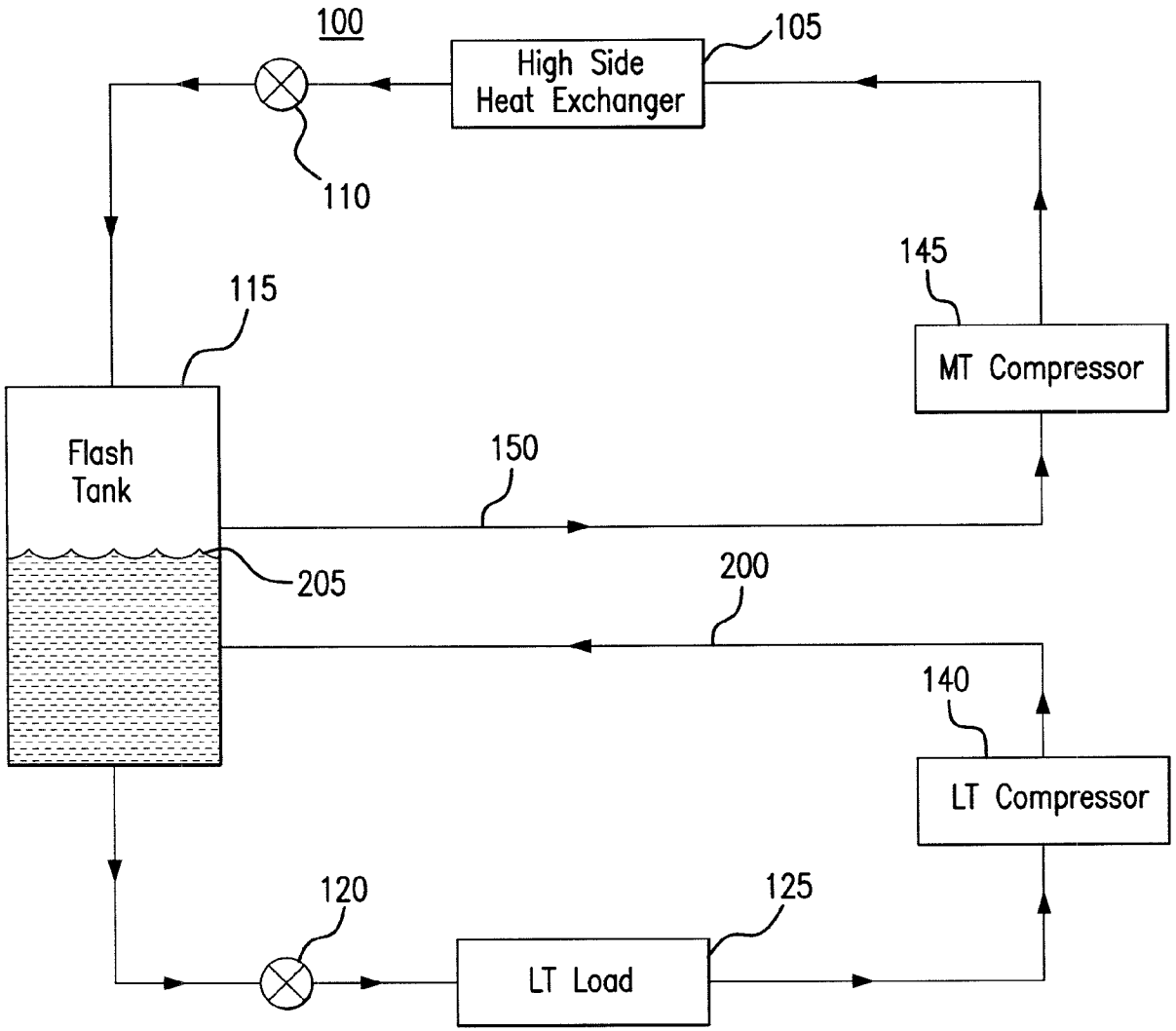
FIG. 2 illustrates the example cooling system of FIG. 1 without a medium temperature load.
Figure 3:
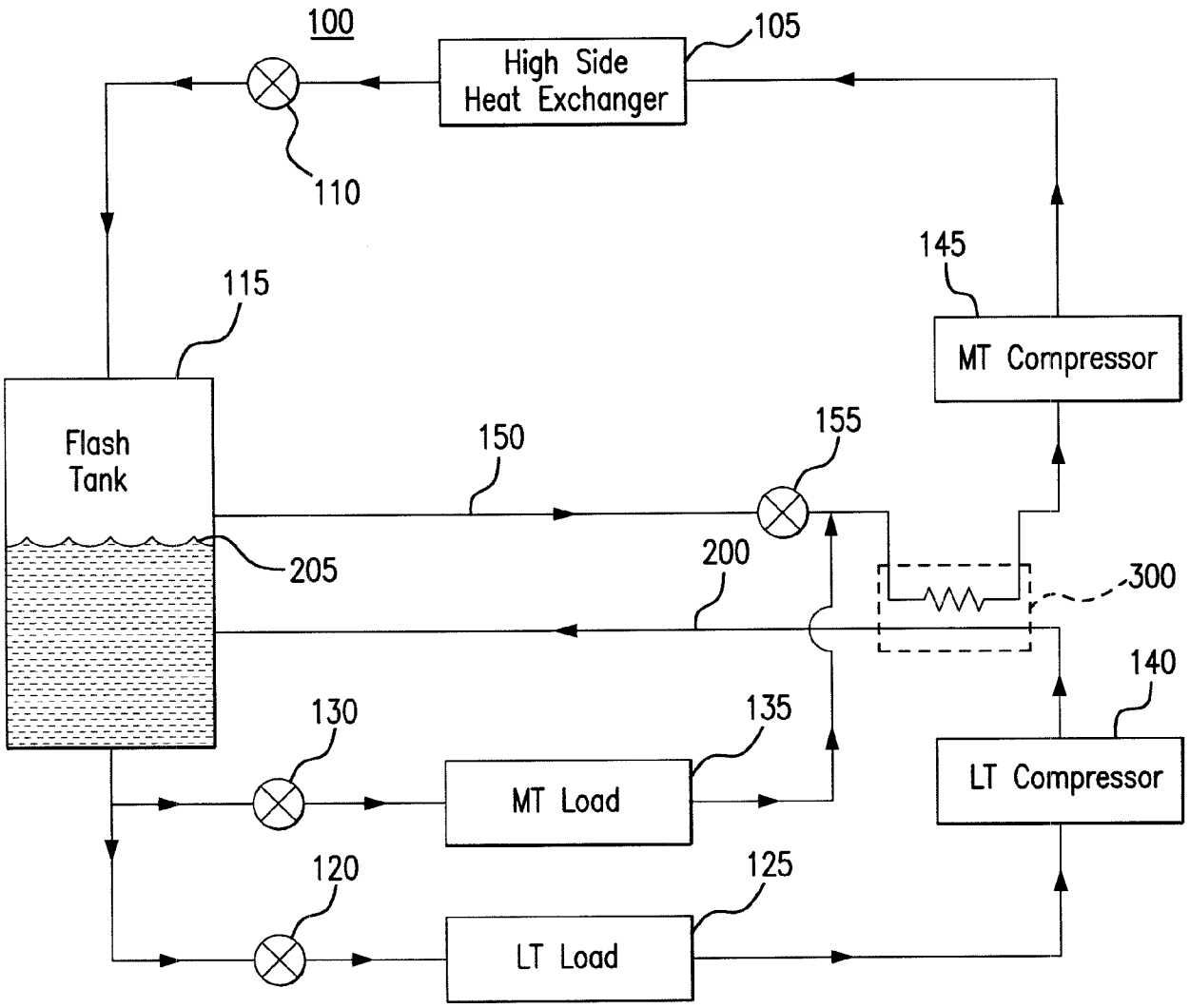
FIG. 3 illustrates the example cooling system of FIG. 1 with imbalanced loads.
Figure 4:
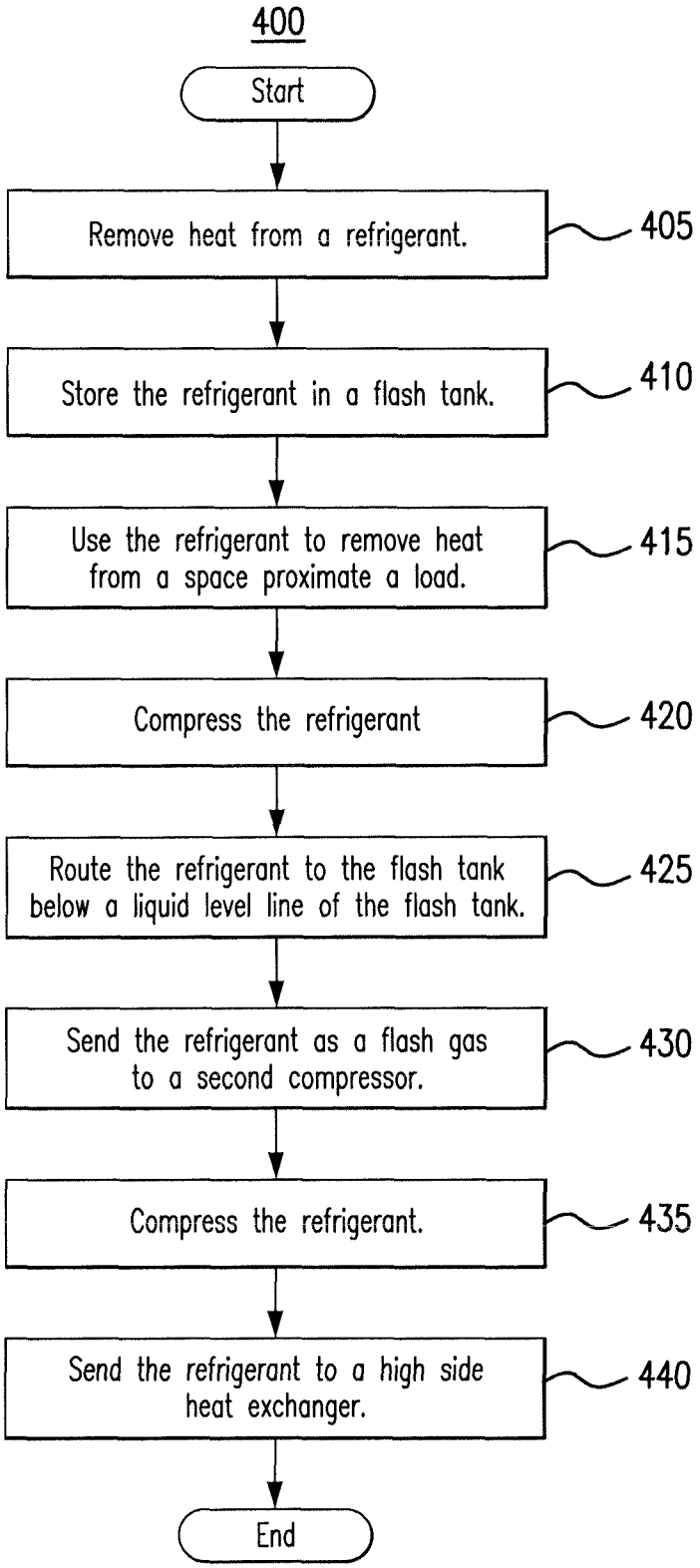
FIG. 4 is a flowchart illustrating a method of operating the example cooling systems of FIGS. 2 and 3.

Cooling systems and the contemplated configuration will be discussed in more detail using FIGS. 1 through 4. FIG. 1 shows a cooling system with a medium temperature load and a low temperature load. FIG. 2 shows the cooling system of FIG. 1 configured without a medium temperature load. FIG. 3 shows the cooling system of FIG. 1 with imbalanced loads. FIG. 4 describes the operation of the system of FIGS. 2 and 3.

As provided in FIG. 1, system 100 includes a high side heat exchanger 105, an expansion valve 110, a flash tank 115, an expansion valve 120, a low temperature load 125, expansion valve 130, a medium temperature load 135, a low temperature compressor 140, a medium temperature compressor 145, and a flash gas bypass line 150. System 100 may circulate a refrigerant to remove heat from spaces proximate low temperature load 125 and medium temperature load 135.

High side heat exchanger 105 may remove heat from the refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools the refrigerant but the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Expansion valves 110, 120, and 130 reduce the pressure and therefore the temperature of the refrigerant. Expansion valves 110, 120, and 130 reduce pressure from the refrigerant flowing into the expansion valves 110, 120, and 130. The temperature of the refrigerant may then drop as pressure is reduced. As a result, warm or hot refrigerant entering expansion valves 110, 120, and 130 may be cooler when leaving expansion valves 110, 120, and 130. The refrigerant leaving expansion valve 110 is fed into flash tank 115. Expansion valves 120 and 130 feed low temperature load 125 and medium temperature load 135 respectively.

Flash tank 115 may store refrigerant received from high side heat exchanger 105 through expansion valve 110. This disclosure contemplates flash tank 115 storing refrigerant in any state such as, for example, a liquid state and/or a gaseous state. Refrigerant leaving flash tank 115 is fed to low temperature load 125 and medium temperature load 135 through expansion valves 120 and 130. Flash tank 115 is referred to as a receiving vessel in certain embodiments.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods and the medium temperature portion may include refrigerated shelves used to hold produce. Refrigerant may flow from flash tank 115 to both the low temperature and medium temperature portions of the refrigeration system. For example, the refrigerant may flow to low temperature load 125 and medium temperature load 135. When the refrigerant reaches low temperature load 125 or medium temperature load 135, the refrigerant removes heat from the air around low temperature load 125 or medium temperature load 135. As a result, the air is cooled. The cooled air may then be circulated such as, for example, by a fan to cool a space such as, for example, a freezer and/or a refrigerated shelf. As refrigerant passes through low temperature load 125 and medium temperature load 135 the refrigerant may change from a liquid state to a gaseous state.

Refrigerant may flow from low temperature load 125 and medium temperature load 135 to compressors 140 and 145. This disclosure contemplates system 100 including any number of low temperature compressors 140 and medium temperature compressors 145. Both the low temperature compressor 140 and medium temperature compressor 145 may be configured to increase the pressure of the refrigerant. As a result, the heat in the refrigerant may become concentrated and the refrigerant may become a high pressure gas. Low temperature compressor 140 may compress refrigerant from low temperature load 125 and send the compressed refrigerant to medium temperature compressor 145. Medium temperature compressor 145 may compress refrigerant from low temperature compressor 140 and medium temperature load 135. Medium temperature compressor 145 may then send the compressed refrigerant to high side heat exchanger 105.

Medium temperature compressor 145 may not be able to safely compress the refrigerant if the temperature of that refrigerant is too high. To regulate the temperature of the refrigerant received by medium temperature compressor 145, the refrigerant from low temperature compressor 140 may be mixed with a cooler refrigerant coming from medium temperature load 135 before being received by medium temperature compressor 145. The refrigerant from low temperature compressor 140 may further be mixed with a cooler flash gas from flash tank 115 via flash gas bypass line 150. By cooling the refrigerant from low temperature compressor 140 before it is received by medium temperature compressor 145 may allow medium temperature compressor 145 to safely compress the received refrigerant.

Flash gas bypass line 150 may be used to mix flash gas from flash tank 115 with the refrigerant from low temperature compressor 140 and medium temperature load 135 before that refrigerant is received by medium temperature compressor 145. The flash gas supplied by flash gas bypass line 150 cools the refrigerant before the refrigerant is received by medium temperature compressor 145. Flash gas bypass line 150 includes expansion valve 155. Expansion valve 155 may further cool the flash gas coming from flash tank 115.

In particular embodiments, the refrigerant from low temperature compressor 140 (125° F.-140° F.) is cooled by both the refrigerant from medium temperature load 135 (25°

F.-35° F.) and the refrigerant from flash gas line 150 (21° F.) at a ratio of about 10%-15% from low temperature load 140, 45%-50% from medium temperature load 135, and 30%-40% from flash gas bypass line 150. This allows medium temperature compressor 145 to operate safely.

The operation of system 100 as illustrated in FIG. 1 may depend on medium temperature load 135 providing enough refrigerant to mix with the refrigerant from low temperature compressor 140. If medium temperature load 135 is not present or is not providing enough refrigerant, then the refrigerant received by medium temperature compressor 145 may be too high a temperature for medium temperature compressor 145 to safely compress. This disclosure contemplates configurations of system 100 that may allow medium temperature compressor 145 to safely compress a received refrigerant when medium temperature load 135 is not present and/or is not providing enough refrigerant. FIGS. 2 and 3 illustrate the alternative configurations. FIG. 4 describes the operation of the alternative configurations.

FIG. 2 illustrates the example cooling system 100 of FIG. 1 with the medium temperature load removed. As illustrated in FIG. 2, system 100 may be configured with a refrigerant routing line 200 when the medium temperature load is removed. As a result of removing the medium temperature load, it is not possible to mix the refrigerant from low temperature compressor 140 with the refrigerant from the low temperature load. As a result, the refrigerant received by medium temperature compressor 145 may be too hot for medium temperature compressor 145 to safely compress. Using the example of a previous embodiment, because the medium temperature load is not present in system 100, the refrigerant from low temperature compressor 140 is not mixed with the refrigerant from the medium temperature load. As a result, the resulting mixture (at around 71° F.) may include about 60% of high temperature gas from the low temperature compressor 140 at around 140° F. and about 40% of the vapor from the flash tank through flash gas bypass line 150 at around 21° F. Because medium temperature compressor 145 may not safely handle refrigerant above 65° F., this mixture may be unsafe to pass to medium temperature compressor 145. Refrigerant routing line 200 allows for the refrigerant from low temperature compressor 140 to be further cooled so that medium temperature compressor 145 can safely compress the refrigerant.

Refrigerant routing line 200 is coupled to low temperature compressor 140 and flash tank 115. Refrigerant routing line 200 routes refrigerant from low temperature compressor 140 to flash tank 115. The refrigerant is routed to a portion of flash tank 115 that is below a liquid level line 205 of flash tank 115. Because the refrigerant routed by refrigerant routing line 200 is typically in the gaseous state, the refrigerant will rise through the liquid refrigerant in flash tank 115. As the refrigerant travels through the liquid refrigerant, the refrigerant is cooled although the refrigerant may remain in the gaseous state. The refrigerant may further mix with the flash gas inside flash tank 115 and/or flash gas bypass line 150, which further cools the refrigerant. After being cooled, the refrigerant may enter flash gas bypass line 150 and travel to medium temperature compressor 145. By routing the refrigerant through flash tank 115, the refrigerant may be cooled sufficiently for medium temperature compressor 145 to safely compress the refrigerant. In this manner, the refrigerant may be sufficiently cooled even though it is not mixed with refrigerant from a medium temperature load.

As illustrated in FIG. 2, flash gas bypass valve 155 is removed from system 100. It is understood however that system 100 may still operate as intended even with flash gas bypass valve 155 included.

FIG. 3 illustrates the example cooling system 100 of FIG. 1 with imbalanced loads. When low temperature load 125 and medium temperature load 135 are imbalanced, medium temperature load 135 may not provide enough refrigerant to mix with the refrigerant from low temperature compressor 140. As a result, the refrigerant received by medium temperature compressor 145 may be too hot to be safely compressed. As illustrated in FIG. 3, system 100 can be configured according to the same guiding principles used in the configuration of FIG. 2 to cool the refrigerant received by medium temperature compressor 145. Refrigerant routing line 200 routes the refrigerant from low temperature compressor 140 to flash tank 115 below a liquid level line 205 of flash tank 115. The refrigerant is then cooled by the refrigerant in flash tank 115 and leaves flash tank 115 through flash gas bypass line 150. Furthermore, the refrigerant from medium temperature load 135 is mixed with the refrigerant in flash gas bypass line 150 before the refrigerant is received by medium temperature compressor 145. As a result, the refrigerant received by medium temperature compressor 145 is at a low enough temperature such that medium temperature compressor 145 can safely compress the refrigerant. In this manner, system 100 may operate safely even if medium temperature load 135 and low temperature load 125 are imbalanced.

In some embodiments, system 100 includes a heat exchanger 300 coupled to flash gas bypass line 150 and refrigerant routing line 200. The heat exchanger transfers heat from the refrigerant in refrigerant routing line 200 to the refrigerant in flash gas bypass line 150. In this manner, the temperature of the refrigerant received by medium temperature compressor 145 may be further regulated to be above a minimum temperature. As a result, the heat exchanger may offset any over cooling resulting from routing the refrigerant through flash tank 115 and/or flash gas bypass valve 155. Furthermore, any liquid refrigerant may be evaporated before reaching medium temperature compressor 145 so that medium temperature compressor 145 does not malfunction. Although this disclosure illustrates heat exchanger 300 in FIG. 3, it is understood that heat exchanger 300 can also be included in the configuration of FIG. 2.

In particular embodiments, system 100 may include a second high side heat exchanger that removes heat from the refrigerant. The second high side heat exchanger is positioned along refrigerant routing line 200 between low temperature compressor 140 and flash tank 115. The second high side heat exchanger may operate as a gas cooler or as a condenser. The second high side heat exchanger may receive refrigerant from low temperature compressor 140, remove heat from that refrigerant, and then send the refrigerant to flash tank 115. In this manner, additional heat may be removed from the refrigerant before it is received by medium temperature compressor 145.

In certain embodiments, a portion of refrigerant routing line 200 may extend into flash tank 115. The portion extending into flash tank 115 may include a plurality of pipes. The refrigerant may travel through these pipes into the liquid refrigerant in flash tank 115. For example, one or more of these pipes may be perforated which allows the gaseous refrigerant to escape through holes in the pipe into the liquid refrigerant in flash tank 115. The gaseous refrigerant may then bubble up through the liquid refrigerant into flash gas bypass line 150. Perforating these pipes may increase the bubbling surface area, which improves heat removal from the refrigerant.

This disclosure contemplates refrigerant routing line 200 and flash tank 115 being configured in any appropriate manner. For example, a baffle may be positioned between refrigerant routing line 200 and flash gas bypass line 150. As another example, the baffle may be positioned at the entrance of flash gash bypass line 150. The baffle may restrain the flow of gaseous refrigerant from refrigerant routing line 200 to flash gas bypass line 150. In this manner, the gaseous refrigerant may spend more time in flash tank 115 thereby further reducing the temperature of the gaseous refrigerant.

Modifications, additions, or omissions may be made to the present disclosure without departing from the scope of the invention. For example, the components of system 100 may be integrated or separated.

FIG. 4 is a flowchart illustrating a method 400 of operating the example cooling system of FIG. 2. Various components of the cooling system perform the steps of method 400. In particular embodiments, by performing method 400 the temperature of a refrigerant may be reduced before the refrigerant is received by a medium temperature compressor.

Method 400 may begin by a high side heat exchanger removing heat from a refrigerant in step 405. The high side heat exchanger sends the refrigerant to a flash tank. In step 410, the flash tank stores the refrigerant. The flash tank sends the refrigerant to a load. In step 415, the load uses the refrigerant to remove heat from a space proximate the load. The load then sends the refrigerant to a first compressor.

In step 420, the first compressor compresses the refrigerant. The first compressor sends the compressed refrigerant to a refrigerant routing line. In step 425, the refrigerant routing line routes the refrigerant to the flash tank below a liquid level line of the flash tank. In this manner, the refrigerant may be cooled by the liquid refrigerant in the flash tank. After being cooled the refrigerant leaves the flash tank through a flash gas bypass line. In step 430, the flash gas bypass line sends the refrigerant as a flash gas to a second compressor. The second compressor compresses the refrigerant in step 435. Then in step 440, the second compressor sends the refrigerant back to the high side heat exchanger.

Modifications, additions, or omissions may be made to method 400 depicted in FIG. 4. Method 400 may include more, fewer, or other steps. For example, steps may be performed in parallel or in any suitable order. While discussed as various components of cooling system 100 performing the steps, any suitable component or combination of components of system 100 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from a refrigerant;

a flash tank configured to store the refrigerant from the high side heat exchanger;

a load configured to use the refrigerant from the flash tank to remove heat from a space proximate the load;

a first compressor configured to compress the refrigerant from the load;

a refrigerant routing line configured to route the refrigerant from the first compressor to the flash tank below a liquid level line of the flash tank, the refrigerant routing line is perforated; and a flash gas bypass line coupled to the flash tank, the flash gas bypass line configured to send the refrigerant as a flash gas from the flash tank to a second compressor, the second compressor configured to compress the refrigerant, the second compressor configured to send the refrigerant to the high side heat exchanger.

2. The system of claim 1, further comprising a second high side heat exchanger configured to remove heat from the refrigerant from the first compressor, the second high side heat exchanger configured to send the refrigerant to the refrigerant routing line.

3. The system of claim 1, further comprising a heat exchanger coupled to the flash gas bypass line and to the refrigerant routing line, the heat exchanger configured to transfer heat from the refrigerant in the refrigerant routing line to the refrigerant in the flash gas bypass line.

4. The system of claim 1, wherein a portion of the refrigerant routing line within the flash tank comprises a plurality of pipes.

5. The system of claim 1, further comprising a baffle between the refrigerant routing line and the flash gas bypass line.

6. The system of claim 1, wherein the high side heat exchanger is operated as a gas cooler.

7. A method comprising:

removing, by a high side heat exchanger, heat from a refrigerant;

storing, by a flash tank, the refrigerant from the high side heat exchanger;

using, by a load, the refrigerant from the flash tank to remove heat from a space proximate the load;

compressing, by a first compressor, the refrigerant from the load;

routing, by a refrigerant routing line, the refrigerant from the first compressor to the flash tank below a liquid level line of the flash tank, the refrigerant routing line is perforated;

sending, by a flash gas bypass line coupled to the flash tank, the refrigerant as a flash gas from the flash tank to a second compressor;

compressing, by the second compressor, the refrigerant; and sending, by the second compressor, the refrigerant to the high side heat exchanger.

8. The method of claim 7, further comprising:

removing, by a second high side heat exchanger, heat from the refrigerant from the first compressor; and sending, by the second high side heat exchanger, the refrigerant to the refrigerant routing line.

9. The method of claim 7, further comprising transferring, by a heat exchanger coupled to the flash gas bypass line and to the refrigerant routing line, heat from the refrigerant in the refrigerant routing line to the refrigerant in the flash gas bypass line.

10. The method of claim 7, wherein a portion of the refrigerant routing line within the flash tank comprises a plurality of pipes.

11. The method of claim 7, wherein a baffle is positioned between the refrigerant routing line and the flash gas bypass line.

12. The method of claim 7, wherein the high side heat exchanger is operated as a gas cooler.

13. A system comprising:

a flash tank configured to store a refrigerant;

a load configured to use the refrigerant from the flash tank to remove heat from a space proximate the load;

a first compressor configured to compress the refrigerant from the load;

a refrigerant routing line configured to route the refrigerant from the first compressor to the flash tank below a liquid level line of the flash tank, the refrigerant routing line is perforated; and a flash gas bypass line coupled to the flash tank, the flash gas bypass line configured to send the refrigerant as a flash gas from the flash tank to a second compressor, the second compressor configured to compress the refrigerant.

14. The system of claim 13, further comprising a high side heat exchanger configured to remove heat from the refrigerant from the first compressor, the high side heat exchanger configured to send the refrigerant to the refrigerant routing line.

15. The system of claim 13, further comprising a heat exchanger coupled to the flash gas bypass line and to the refrigerant routing line, the heat exchanger configured to transfer heat from the refrigerant in the refrigerant routing line to the refrigerant in the flash gas bypass line.

16. The system of claim 13, wherein a portion of the refrigerant routing line within the flash tank comprises a plurality of pipes.

17. The system of claim 13, further comprising a baffle between the refrigerant routing line and the flash gas bypass line.

18. The system of claim 13, further comprising a high side heat exchanger operated as a gas cooler.

* * * * *